US005275408A

United States Patent [19]

Desbiolles et al.

[11] Patent Number: 5,275,408

[45] Date of Patent: Jan. 4, 1994

[54] DEVICE FOR THE ATTACHMENT OF THE HEAD OF A GOLF CLUB ON THE HANDLE

[75] Inventors: Jacques Desbiolles; Augustin Gomez, both of Annecy; Freddie Pons, Cran Gevrier, all of France

[73] Assignee: Taylor Made Golf Company, Inc., Carlsbad, Calif.

[21] Appl. No.: 612,853

[22] Filed: Nov. 14, 1990

[30] Foreign Application Priority Data

Nov. 14, 1989 [FR] France ..... 89 14924

[51] Int. Cl.[5] ..... A63B 53/02

[52] U.S. Cl. ..... 273/80.1; 273/80.2; 273/80.4

[58] Field of Search .... 273/80.1-80.9, 80C, 167G, 79, 80R, 167R, 194R, 193R-B

[56] References Cited

U.S. PATENT DOCUMENTS

| | | | |
|---|---|---|---|
| 695,579 | 3/1902 | Parmele | 273/80.2 |
| 697,179 | 4/1902 | Slazenger | 273/80.2 |
| 1,501,344 | 7/1924 | Hubbard | 273/80.2 |
| 1,879,117 | 9/1932 | Davidson | 273/79 |
| 2,067,556 | 1/1937 | Wettlaufer | 273/80.1 |
| 2,153,880 | 4/1939 | Barnhart | 273/80.4 |
| 2,363,991 | 11/1944 | Reach | 273/80.2 |
| 2,451,262 | 10/1948 | Watkins | 273/79 |
| 3,429,576 | 2/1969 | Ikeda | 273/80.1 X |
| 3,625,513 | 12/1971 | Ballmer | 273/80.5 |
| 3,848,737 | 11/1974 | Kenon | 273/80.1 X |
| 4,622,836 | 11/1986 | Long et al. . | |
| 4,854,582 | 8/1989 | Yamada | 273/80.1 X |
| 4,943,059 | 7/1990 | Morell | 273/80.1 |
| 4,984,794 | 1/1991 | Pernelle et al. | 273/80.1 |

FOREIGN PATENT DOCUMENTS

| | | | |
|---|---|---|---|
| WO/8704634 | 8/1987 | European Pat. Off. | 273/80.2 |
| 1939371 | 2/1970 | Fed. Rep. of Germany . | |
| 30050 | of 1913 | United Kingdom | 273/80.2 |
| 386124 | 1/1933 | United Kingdom | 273/80.4 |
| 429666 | 6/1935 | United Kingdom | 273/80.4 |

*Primary Examiner*—V. Millione
*Assistant Examiner*—Sebastiano Passaniti
*Attorney, Agent, or Firm*—Sandler Greenblum & Bernstein

[57] ABSTRACT

A golf club with a head provided, on its upper part, with a neck on which is affixed the lower part of a handle by the neck and the handle fitting into each other. The base of the contact surface of the golf club, between the external side of the neck and the internal side of the handle, is distant from the base of the neck, by which the latter connects to the upper part of the head, at a predetermined length which is equal to that which will eventually be subjected to bending.

16 Claims, 4 Drawing Sheets

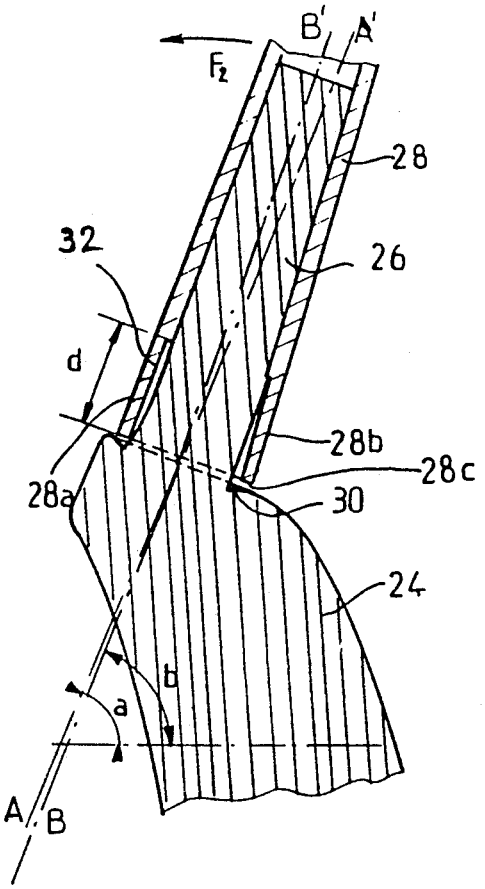
FIG. 4
FIG. 5
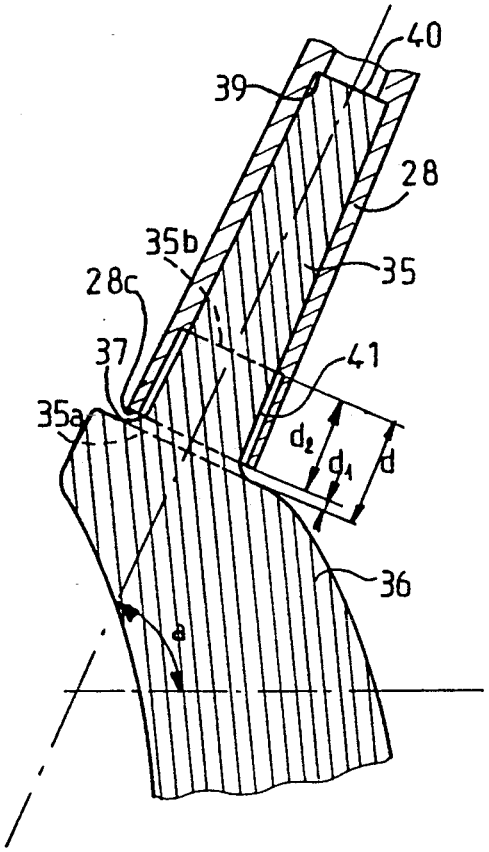
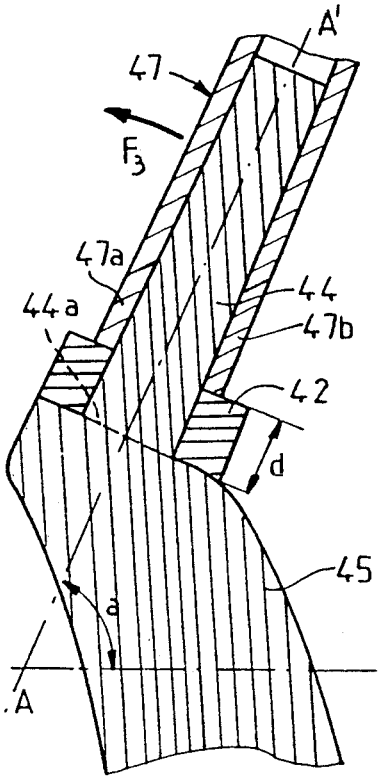
FIG. 6

DEVICE FOR THE ATTACHMENT OF THE HEAD OF A GOLF CLUB ON THE HANDLE

BACKGROUND OF THE INVENTION

1. Field of the Invention

The present invention concerns a mounting device for the head of a golf club on the handle.

2. Description of Background and Other Information

A golf club is conventionally made of a metal handle, and the head is connected to it by an upward extension called the "neck". The assembly of the head and the handle generally occurs by fitting and bonding, particularly by gluing, of the handle on the neck. The head of the golf club constitutes the official hitting component. For the hit to be correct, it is necessary that this head rest completely flat on the ground, the handle of the club then forming the angle in relation to the horizontal plane of the ground, this angle constituting the angle called the "lie" of the handle.

It can be easily conceived that the angle of lie of a golf club varies as a function of the player and essentially depends on his playing position and height. In the case of a club such as a "putter", the three angles of lie are generally defined corresponding to three positions of the golf player, namely, a median position and two extreme positions obtained by a shift of about 2° from the axis of the handle on either side of the median position. It is attempted, particularly in the case of the precision clubs such as "putters", to be able to easily modify the angle of lie in a manner to adjust it to the playing position of the player.

Different solutions have been proposed to resolve this problem, and particularly that consisting of deforming the neck after assembling the golf club. In the case of traditional "putters", that is "putters" in which the upper part of the head supporting the neck possesses a certain malleability in relation to the head, strictly speaking, the deformation occurs at the level of this upper part and is progressively distributed along the length of it.

On the contrary, in certain "putters" called "swan neck", the upper part of the head has a structure which gives it a rigidity so that it cannot bend. In this case, the bending stress is supported by the neck and is exercised on it at the level of the connection zone between the base and the upper part of the head. However, this zone is particularly narrow so that the bending stress often leads to a break in the base of the neck or an abrupt break in the alignment between it and the handle.

It has also been proposed to adjust the angle of lie to the desired value by using a system of shims provided on the neck and/or on the inside of the handle, whose relative thicknesses are combined to pass incrementally from a median value of the angle of lie to the upper or lower values, as disclosed in commonly owned French Application No. 88.06187 filed on Jun. 2, 1988.

SUMMARY OF THE INVENTION

The goal of the present invention is a device to remedy these drawbacks, allowing for the adjustment in exact and progressive fashion of the angle of lie without the risk of damaging the golf club.

To this end, the object of the present invention is a golf club with a head provided, on its upper part, with a neck on which is attached the lower part of the handle, by mutual fitting of the neck and the handle, characterized in that the base of the contact surface between the external side of the neck (or the handle) and the internal side of the handle (or neck) is distant from the base of the neck by which it connects to the upper part of the head, by a predetermined length equal to the length which will eventually be bent.

Thus, according to the invention, the bending effort applied on the neck is distributed along a given length of it, and it is easily adjustable as a function of the material used.

The present invention thus permits, in considering the length of the neck subject to bending as a function of the material constituting the head of the golf club, regulation of the stress inside the neck such that it occurs beyond the elastic limit and within the rupture limit of the material.

In a variation, the length of the neck subject to bending is determined by a ring, made of a compressible or ductile material, around the neck between its base and the lower end of the golf club handle, the thickness of this ring determining the length of the neck subject to bending. In this manner, on the one hand the separation is determined in an exact and easy fashion, and on the other, during the bending exercised by the handle of the club on the neck, the lower end of the handle compresses the ring, permitting one to obtain a precise adjustment between it and the upper part of the head of the club.

In an interesting variation on the invention, an intermediary compressible ring is used to assure the seal during the gluing operation between the handle and the neck of the head of the golf club, necessary so that the glue does not overflow.

BRIEF DESCRIPTION OF THE DRAWING

The above and additional objects, characteristics, and advantages of the present invention will become apparent in the following detailed description of preferred embodiments, with reference to the accompanying drawing which is presented as a non-limiting example, in which:

FIGS. 3 and 4 are partial cross-sections of a golf club according to the invention, before and after adjusting the angle of lie, respectively; and FIGS. 5–10 are partial cross-sections of different variations on the construction of the invention.

DETAILED DESCRIPTION OF PREFERRED EMBODIMENTS

In these figures we have, for reasons of clarity, illustrated only the elements of the head and the golf club handle which are part of the assembly.

Figure 1:
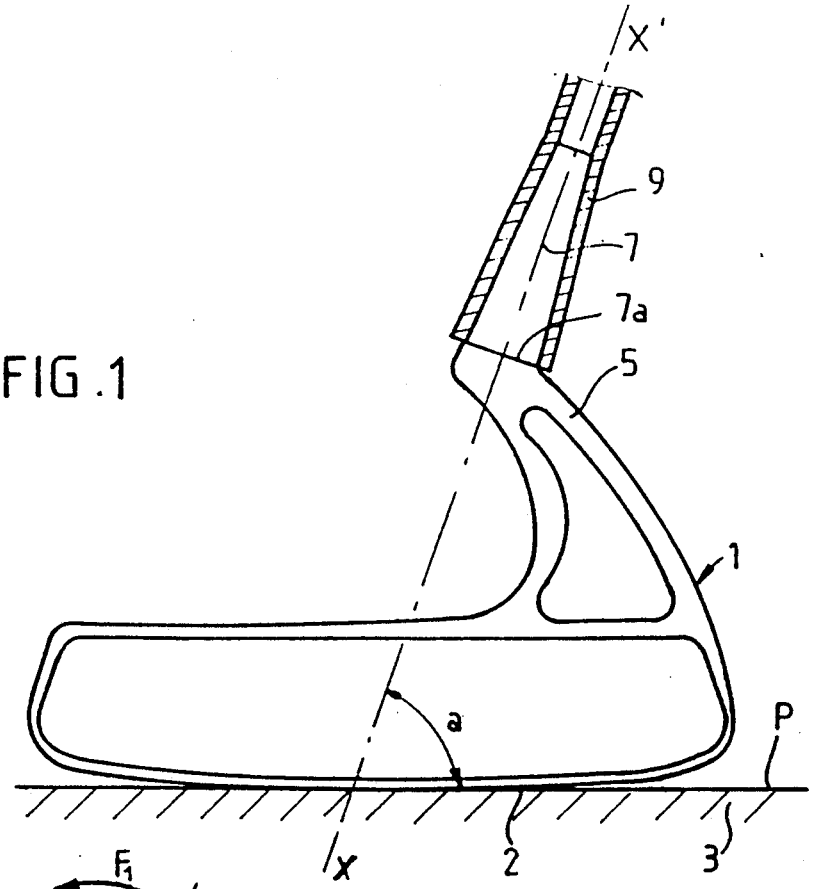
FIG. 1 is a vertical cross-section of the head and the lower part of the golf club handle according to the state of the art.
Figure 2:
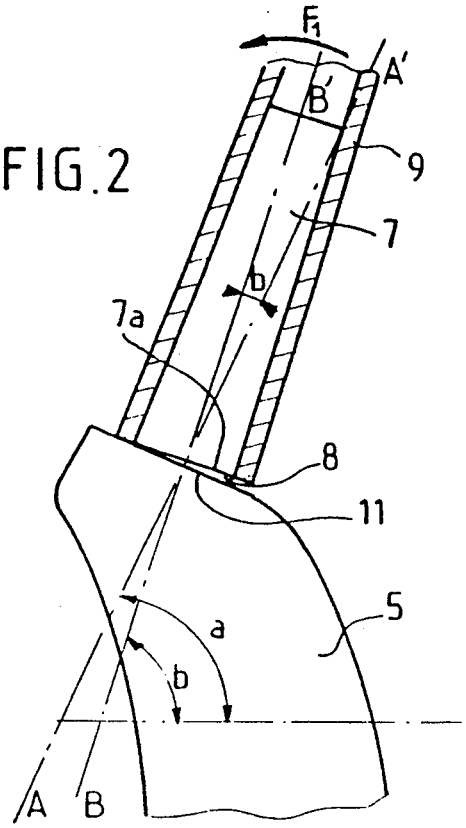
FIG. 2 is a partial cross-section on a larger scale of the junction between the upper part of the head and the lower part of the golf club handle in FIG. 1, after adjusting the angle of lie.

In FIGS. 1 and 2 a golf club, more precisely a "putter" of the "swan neck" type, with a head 1 whose lower flat side 2 rests on the horizontal ground plane P, and whose upper part 5 is extended by a tapered neck 7 on which is attached by gluing the lower part of a tubular handle or shaft 9 fitted onto the neck.

A lengthwise axis xx' of the assembly constituted by the neck 7 and the handle 9 forms, in the position illustrated in FIG. 1, an angle a called "the angle of lie" with the horizontal ground plane P.

When one wishes to modify the angle of lie a, a bending pressure is exerted on the handle 9, for example towards the front of the head 1 as indicated by arrow F1 in FIG. 2; when one wishes to increase the angle of lie, to move the axis xx' of handle 9 from the position AA' where it possesses the angle of lie a, to position BB' (FIG. 2) where it possesses an angle of lie b greater than angle a We can determine that during this pressure the stress exerted by the bending force F1 on the handle 9 is applied at the level of a juncture between the base 7*a* of the neck 7, by which the latter connects to the upper part of the head 1, and the lower end of the handle 9. This pressure is thus concentrated in a short region, horizontally and longitudinally, in the direction of axis xx', leading to the generation of significant stress in the material used, and can lead in certain cases, according to the nature of the material used, to the beginning of a fracture 8, or a break, pure and simple.

Figure 3:
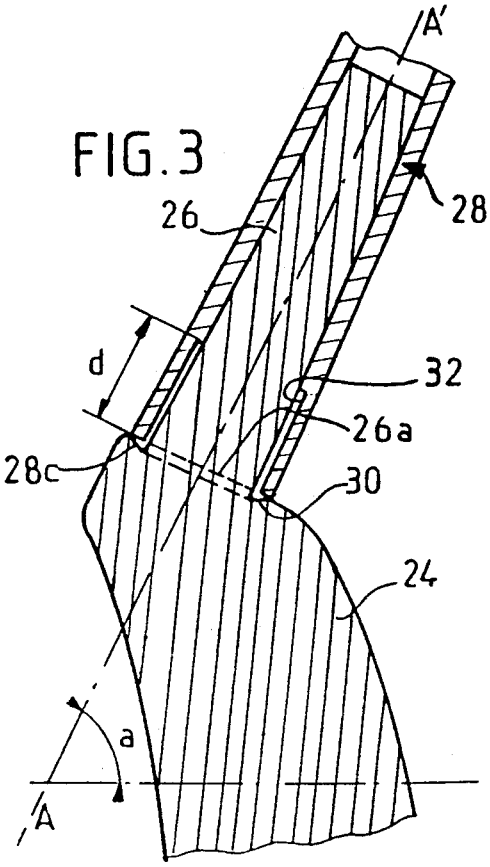

In FIGS. 3 and 4 of the upper part 24 of the head of the golf club is extended upward by a tapered neck 26. The neck 26 is engaged in the lower end part of a tubular handle 28 whose lower end 28*c* rests against the upper part 24 of the head. The base 26*a* of the tapered neck 26 is encircled by a ring groove 30 hollowed in the upper surface of the upper part 24 of the head of the golf club. The lower part of the internal side of the handle 28 is hollowed out along a length d from its lower end by a shallow internal ring-shaped recess 32 of essentially constant depth. As a result, below a lower end of the contact area between the internal surface of the handle and the external surface of the neck, the lower part of the internal side of the handle is no longer in contact with the neck 26 along the length d. Consequently, as in FIG. 4, when a bending pressure is exerted on the handle 28 in a given direction, for example in the direction of arrow F2 if one wants to increase the angle of lie, the bending pressure applied during this movement is exerted from this point along the entire length d of the neck 26 which is not in contact with the internal side of the handle 28. In this manner, the bending pressure is distributed along the portion of the neck of length d, and no longer concentrated in a particular section, and the resulting deformation of the neck is, as a consequence, progressive. The stress is thus less than it was when it was concentrated in the base 26*a* of the neck 26.

As a function of the material used to make the head of the golf club, one can, by varying the length d in an appropriate manner, limit the stress rate inside the material such that it occurs within a determined range of values, especially beyond the elastic limit of the material, such that the latter retains the deformation applied to it, and within the rupture limit, in order to avoid breaking the neck 26.

During the deformation of the neck 26 by the action of force F2 tending to increase the angle of lie, the part 28*a* of the handle 28 situated on the side towards which the pressure F2 is exerted, approaches the base 26*a* of the neck 26, which is possible because of the presence of the ring groove 30, receiving its lower end 28*c*, while the part 28*b* of the handle 28 which is situated on the opposite side moves away from the base 26*a* of the neck 26, as seen in FIG. 4.

In FIG. 5, the neck 35 connects to the upper part of the head of the club by a flared part 37. The internal side of the tubular handle 28 has, at a distance from its lower end 28*c*, a ring-shaped shoulder 39 coming in contact with the upper end 40 of the neck 35, in a way which provides a space of length d1 between the base 35*a* of the neck 35 and the lower end 28*c* of the handle. As in FIGS. 3 and 4, the internal side of the lower part of the handle 28 is hollowed along a length d2 from its lower end by an interior ring-shaped recess 41 allowing for the provision in this spot between the external side of the neck 35 and the internal side of the handle 28, of a ring-shaped space along the length d2. Thus, the base 35*b* of the contact surface between the external side of the neck 35 and the internal side of the handle 28 is at a distance of $d = d1 + d2$ from the base 35*a* of the neck 35, representing the length of a neck submitted to bending. The recess 41 also permits the lower part of the handle 28 to shift in relation to the neck 35 at the beginning of the bending operation.

In the variation represented in FIG. 6, a ring 42 made of a compressible material, of thickness d, is placed on the neck 44 of the head of a golf club between the upper part 45 of this head, around the base 44*a* of the neck 44 and the lower end of the handle 47. In this way, during a movement causing the handle 47 to bend in the direction F3, the part 47*a* of the handle 47 which is located on the side towards which the pressure F3 is exerted can penetrate, at its lower end, the interior of the compressible ring 42, while the part 47*b* of the handle which is situated on the opposite side moves out of this ring. In order to avoid the creation of an unesthetic space after the bending operation, before this occurs one can, during the assembly and before gluing, place an axial pressure on the handle 47, in order to make it penetrate into the interior of the elastic ring, so that after bending, the part of the handle 47*b* does not come out of the ring 42.

Figure 7:
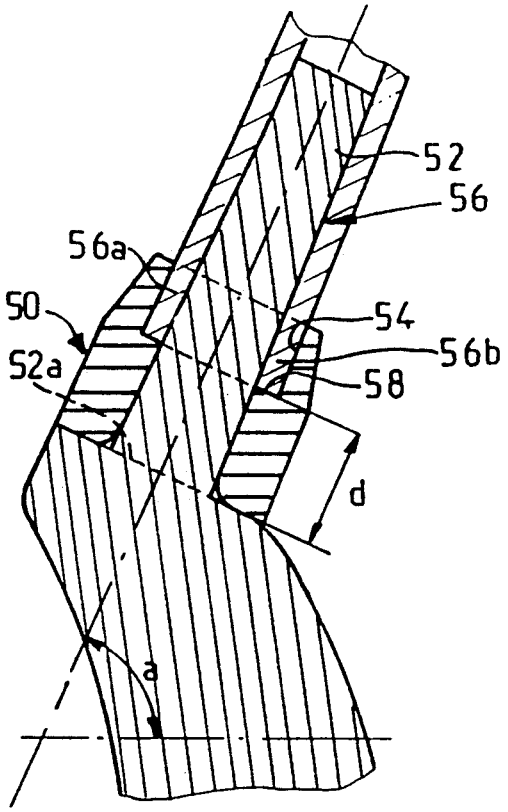

In the variation illustrated in FIG. 7, an elastic ring 50 is placed on the neck 52 of the head of a golf club and its upper part is hollowed by a coaxial cylindrical cavity 54 of a larger diameter receiving the lower part of the handle 56 of the club. A bottom 58 of this cavity, which constitutes a stop for the lower end of the handle 56, is at a distance d from the base 52*a* of the neck 52, representing the length of the latter when bent. In this construction form, the opposing end parts 56*a*, 56*b* of the handle 56 can shift inside the elastic ring 50 without the resulting deformations being visible from the exterior, which permits the achievement of a juncture surface between the neck of the club and the handle which is esthically satisfactory.

In addition, the elastic ring 50 plays the role of a sealing joint during the assembly operation, since it constitutes an elastic blocking system preventing the glue put between the neck and the internal periphery of the handle to come back out, which avoids delicate cleaning operations.

Figure 8:
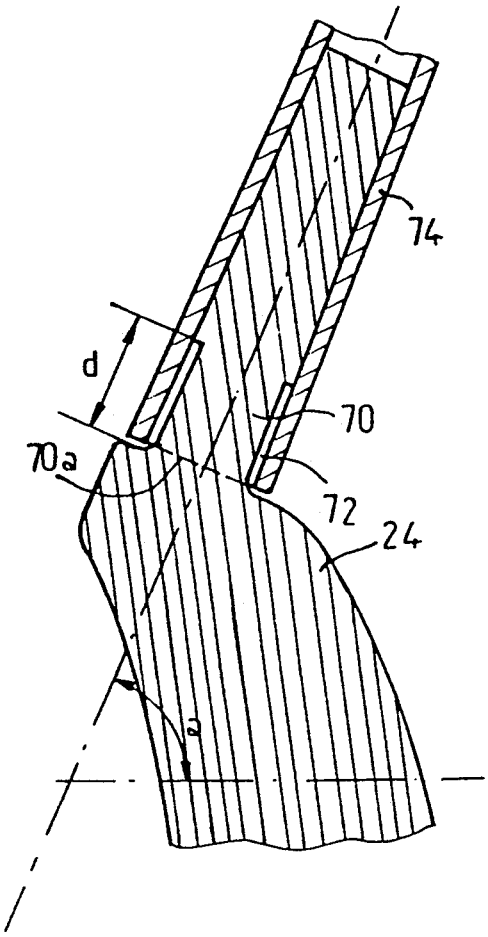

One can, of course, modify the details of the operation, without going beyond the framework of the invention. Thus, as shown in FIG. 8, the ring-shaped recess 72 of length d existing between the external side of the neck 70 and the internal side of the handle 74 can be made by hollowing out this recess in the neck 70 where it connects to the upper part 24 of the head of the golf club, starting at the base 70*a* of the neck.

Figure 9:
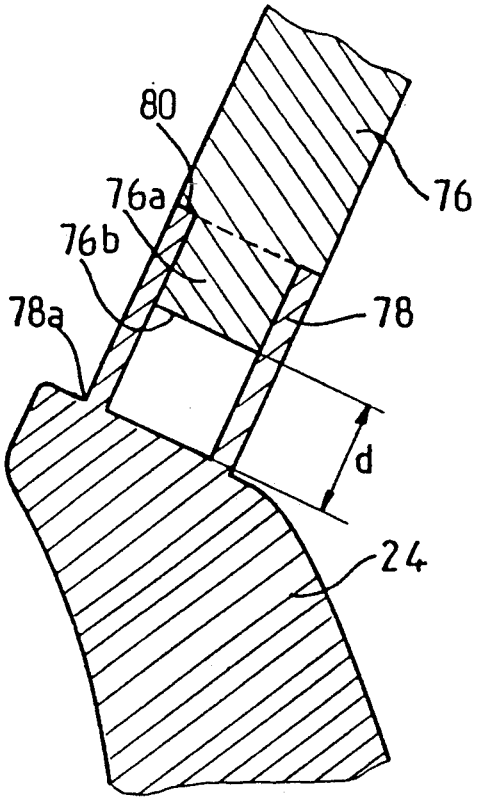

In the variation of construction represented in FIG. 9, the lower end part 76*a* of the handle 76 of the golf club is solid and tightly fitted in an axial direction into the tubular-shaped neck 78, open at its upper end. This lower end part of the handle 76 has a diameter less than that of the rest of the handle and is equal to the internal diameter of the tubular neck 78 and its length is less than the value d of the length of the tubular neck 78. The handle 76 is pressed against the upper end of the tubular neck 78 by the intermediary of a shoulder 80 which is formed in the connecting zone of the two parts of different diameters. Because of this arrangement, the lower end 76*b* of the handle 76 is maintained at a distance d from the base 78*a* of the neck 78, with a free space between the lower end 76*b* of the handle 76 and the base 78*a* of the neck 78.

Figure 10:
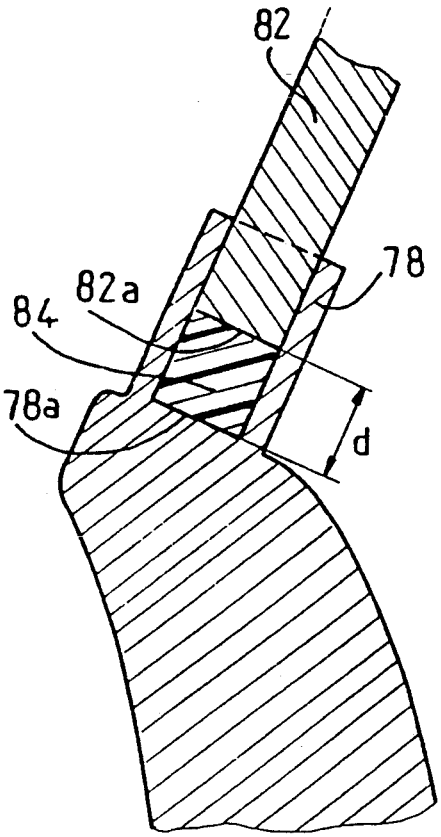

In the variation of construction represented in FIG. 10, the lower part of the handle 82 is made of a solid rod whose diameter is equal to the internal diameter of the tubular neck 78, and which is engaged in this neck. The lower end 82*a* of the handle 82 is maintained at a distance d from the base 78*a* of the neck 78 by a block 84 of thickness d, in a compressible and possibly elastic material.

In the case of the two forms of construction described above, referring to FIGS. 9 and 10, the stress to which the tubular neck 78 is subjected when a bending force is exerted on the handle 76, 82 distributed along the entire length of the lower section of the tubular neck 78 which is left free between the lower end of the handle and the base 78*a* of the neck 78.

What is claimed is:

1. A golf club comprising:

a handle, said handle having an internal surface, a lower part, said lower part having a lower end;

a head, said head having an upper part and a neck extending from said upper part, said neck having an external surface and a base;

said neck extending within said lower part of said handle;

said neck and said lower part of said handle having a contact area between said external surface of said neck and said internal surface of said handle, said contact area having a lower end;

said base of said neck and said lower end of said contact area between said external surface of said neck and said internal surface of said handle being spaced apart along a predetermined distance by an annular recess between said external surface of said neck and said internal surface of said handle for permitting bending of said lower part of said handle along said predetermined distance;

said handle having an external diameter at said lower end of said contact area, and said neck having an external diameter at a location below said lower end of said contact area; and said external diameter of said handle at said lower end of said contact area being greater than said external diameter of said neck at said location below said lower end of said contact area.

2. The golf club of claim 1, said annular recess being provided in said external surface of said neck and extending from said base of said neck upwardly by said predetermined distance.

3. The golf club of claim 1, said neck being comprised of a material having a predetermined elastic limit of deformation, said lower end of said neck and said lower end of said contact area between said external surface of said neck and said internal surface of said handle being spaced apart by a further predetermined distance comprising means for facilitating bending of said lower part of said handle relative to said lower end of said neck by an amount greater than said predetermined elastic limit of said neck for permitting said neck to retain a predetermined amount of deformation resulting form said bending.

4. The golf club of claim 1, said neck having a further external diameter at said lower end of said contact area that is greater than said external diameter of said neck at said location below said lower end of said contact area.

5. The golf club of claim 1, said annular recess being provided in said internal surface of said handle at said lower part of said handle.

6. The golf club of claim 5, said lower part of said handle being in engagement with said upper part of said head.

7. The golf club of claim 5, said neck having an upper end, said handle having an internal shoulder spaced upwardly from said lower end of said handle, said internal shoulder in engagement with said upper end of said neck, said lower end of said handle being spaced from said base of said neck.

8. A golf club comprising:

a handle, said handle having an internal surface, a lower part, said lower part having a lower end;

a head, said had having an upper part and a neck extending from said upper part, said neck having an external surface and a base;

said neck extending within said lower part of said handle;

said neck and said lower part of said handle having a contact area between said external surface of said neck and said internal surface of said handle, said contact area having a lower end;

said base of said neck and said lower end of said contact area between said external surface of said neck and said internal surface of said handle being spaced apart along a predetermined distance for permitting bending of said lower part of said handle along said predetermined distance;

said handle having an external diameter at said lower end of said contact area, and said neck having an external diameter at a location below said lower end of said contact area;

said external diameter of said handle at said lower end of said contact area being greater than said external diameter of said neck at said location below said lower end of said contact area; and an intermediate ring between said base of said neck and said lower end of said handle, said lower end of said handle being pressed against said intermediate ring.

9. The golf club of claim 8, said intermediate ring being comprised of a deformable material.

10. The golf club of claim 9, said intermediate ring being comprised of an elastic material.

11. The golf club of claim 9, said intermediate ring comprising a cylindrical cavity, and said lower end of said handle being embedded within said cylindrical cavity.

12. A golf club comprising:

a shaft having at least a lower tubular part, said lower tubular part having an internal surface and a lower end;

head, said head having an upper part and a neck extending from said upper part, said neck having an external surface, an upper part and a base;

said neck extending within said lower tubular part of said handle and at least a portion of said internal surface of said lower tubular part of said shaft to define a contact area; and at least a further portion of said external surface of said neck being spaced from and not engaging any portion of said internal surface of said lower tubular part of said shaft to define a non-contacting area, said non-contacting area forming an annular recess between said external surface of said neck and said internal surface of said lower tubular part of said shaft.

13. The golf club of claim 12, said lower end of said lower tubular part of said shaft being spaced from said upper part of said head.

14. The golf club of claim 12, said annular recess being provided within said upper part of said head, said annular recess surrounding said base of said neck and below said lower end of said lower tubular part of said shaft.

15. The golf club of claim 12, said internal surface of said lower tubular part of said shaft having an upper internal surface portion and a lower internal surface portion, said lower internal surface portion having a diameter greater than a diameter of said upper internal surface portion.

16. The golf club of claim 12, said external surface of said neck having an upper external surface portion and a lower external surface portion, said lower external surface portion having a diameter less than a diameter of said upper external surface portion.

* * * * *